US005485931A

United States Patent [19]

Barr, Jr.

[11] Patent Number: 5,485,931

[45] Date of Patent: Jan. 23, 1996

[54] HAIR DRYER CADDY

[76] Inventor: John F. Barr, Jr., R.R. 3, Box 68, Delanson, N.Y. 12054

[21] Appl. No.: 141,774

[22] Filed: Oct. 25, 1993

[51] Int. Cl.[6] ..... A47F 7/00

[52] U.S. Cl. ..... 211/70.6; 211/60.1; 211/87; 248/314

[58] Field of Search ..... 211/70.6, 60.1, 211/87, 70.7; 248/314, 309.1, 117.1, 223.4, 225.1, 224.4

[56] References Cited

U.S. PATENT DOCUMENTS

| | | | |
|---|---|---|---|
| 2,371,433 | 3/1945 | Davis | 211/70.6 |
| 3,003,734 | 10/1961 | Davis et al. | 248/223.4 X |
| 3,269,550 | 8/1966 | Marcus | 211/70.6 |
| 3,964,708 | 6/1976 | Reeves | 248/314 X |
| 4,159,773 | 7/1979 | Losenno | 211/70.6 |
| 4,225,106 | 9/1980 | Eplan . | |
| 4,446,972 | 5/1984 | Sussman | 211/60.1 X |
| 4,673,148 | 6/1987 | Oliver . | |
| 4,696,447 | 9/1987 | Strecker | 248/314 X |
| 4,746,090 | 5/1988 | Hamilton | 248/314 |
| 4,871,074 | 10/1989 | Bryson et al. | 211/70.6 X |
| 5,054,615 | 10/1991 | Stillwagon et al. | 211/70.6 X |

*Primary Examiner*—Robert W. Gibson, Jr.
*Attorney, Agent, or Firm*—Schmeiser, Morelle & Watts

[57] ABSTRACT

The invention is a holder for hair drying and shaping implements. The holder has front and rear sections with each section having a number of vertically-oriented thru-bores. Each thru-bore is open at its top and bottom ends and also has a side, slot-like opening. The top surface of the front section of the holder is inclined relative to a horizontally-oriented plane. The bores located in the holder's front section are designed to receive the handle portion of hair drying or shaping implements. The bores in the rear section of the holder are designed to releasably receive the electrical cords of the hair drying or shaping implements.

11 Claims, 2 Drawing Sheets

HAIR DRYER CADDY

FIELD OF THE INVENTION

The invention is in the field of accessories for hair dryers. More particularly, the invention is a holder for a hair dryer and is designed to be attached to a vertical support such as a wall. The holder includes a plurality of vertically-oriented holes adapted to inwardly receive handle portions of a variety of hair drying or arranging implements. The holder further includes slotted receivers for the electrical cords of the supported hair implements.

BACKGROUND OF THE INVENTION

There are many implements commonly used for styling and drying a person's hair. These implements range from simple combs and brushes to electrically-powered hair dryers and curling irons. However, many people do not have a convenient storage facility available for the large number of relatively bulky hair implements commonly in use.

Most people will store smaller hair implements such as combs and brushes in a readily accessible location. Larger implements, such as hair dryers and curling irons, will usually be stored in a less accessible place such as a closet. This causes a user to spend time retrieving said larger implements and then having to connect each in turn to the proper electrical receptacle.

An additional problem is often experienced when larger hair implements such as a hair dryer are used. Due to the size and weight of the device, it can become tiring and difficult for a user to hold and support the device for a long period of time.

In attempting to solve some of the above-noted problems, a number of different hair dryer holders have been invented. These holders are secured to a vertical structure such as a wall and include bracket structure designed to fasten onto the air outlet portion of the dryer. The holders effectively convert a portable hair dryer into a permanently mounted dryer. Once a hair dryer is secured to a holder, a user cannot easily remove the dryer nor is the holder capable of receiving multiple hair implements. In addition, prior art hair dryer holders are not adapted in any way to conveniently store the electrical cord of the dryer or other electrically-powered hair implement.

SUMMARY OF THE INVENTION

The invention is a holder designed to receive and support a plurality of hair styling and drying implements. The holder is adapted for releasable attachment to a vertical support surface, such as a wall, using a two-part mounting system. The holder includes a plurality of vertically-oriented holes with each hole having open top and bottom ends and a slot-like side opening. Each hole is adapted to inwardly receive the handle portions of a hair drying or arranging implement. The holder further includes a plurality of shaped receivers for releasably storing the electrical cords of the supported hair implements.

When a hair dryer is located in one of the holes of the holder, the nozzle of the dryer can be oriented so that it directs the air flow toward a user's hair. The holder includes structure that will inherently orient the dryer in a forward facing position without requiring any clamps or brackets that fasten onto the dryer. Therefore, unlike the prior art devices, the invention allows the dryer to be easily removed from the holder by the user. In this manner, the dryer can function as a wall-mounted unit as well as a portable unit in which the user manually holds the dryer so as to direct the air flow to best advantage. The receivers for the electrical cords allow ready removal and replacement of any of the cords so that the user can remove any amount of cord necessary to facilitate handling of the dryer. After use, the cord(s) can be manually folded and then pushed back into the appropriate receiver.

DETAILED DESCRIPTION OF THE DRAWINGS

Figure 2:
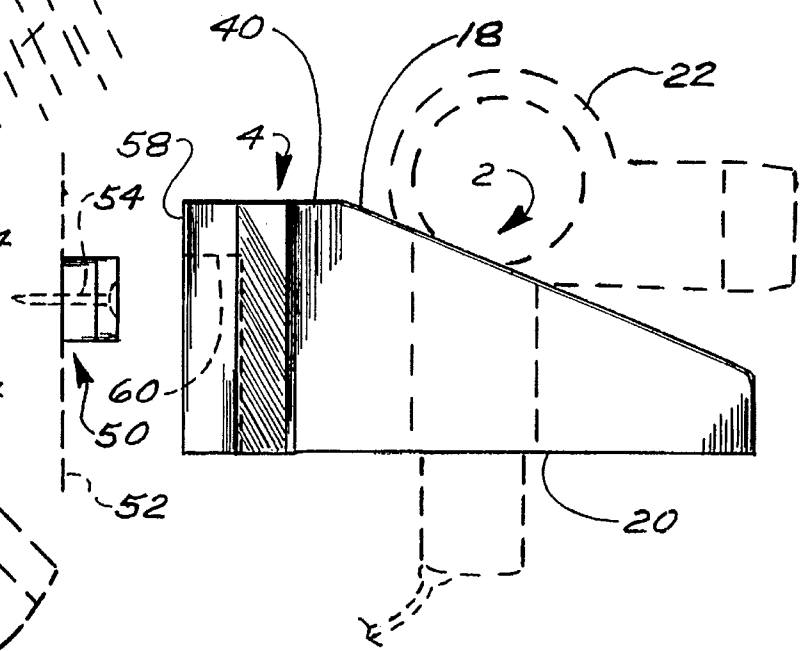
FIG. 2 is a side view of the holder shown in FIG. 1 with a hair dryer shown in phantom and the holder removed from its mounting bracket.

Referring now to the drawings in greater detail, wherein like reference characters refer to like parts throughout the several figures, there is shown by the numeral 1 a holder in accordance with the invention.

The holder is preferably made of a rigid material such as plastic or wood. The holder has a trapezoidally-shaped front section 2 and a rectangular rear section 4. The front section includes three apertures or thru-bores 6, 8 and 10. Each aperture has a side-located entrance slot 12, 14 and 16 respectively. Each of the slots extends from the angled top surface 18 of the holder's front section to the holder's bottom surface 20.

Aperture 6 is preferably larger than apertures 8 and 10 and has an interior diameter of approximately two inches. This aperture is designed to receive the handle of a hair dryer. A typical hair dryer 22 is shown in phantom. The slot 12 is used to allow a convenient pass-thru for the dryer's electrical cord 24 (also shown in phantom).

Aperture 8 is preferably approximately 1.2 inches in diameter and is designed to receive the handle of an implement such as a traditional hair brush or an electrically-heated brush. A brush 26 is shown in phantom. If an electric implement is to be stored in this aperture, slot 14 provides a pass-thru for the cord.

Aperture 10 is designed to receive the handle of another implement for hair styling. The aperture is approximately 1.6 inches in diameter and is shown being used to support an electric curling iron 30 that is shown in phantom. The aperture's side-located slot 16 is used as a pass-thru for the iron's cord 32.

The front section of the holder has a top surface 18 that is angled downwardly toward the holder's front edge 34. Preferably, the angle of incline is approximately thirty degrees from a horizontal plane that can be imagined as an extension of the horizontal top surface 40 of the holder's rear section. By making the top surface of the front section an inclined plane, the holder will inherently fix the orientation of the received hair dryer so that the dryer will tend to point forwardly. The dryer can be manually angled to a different orientation, but a front facing position is obviously favored by the structural layout of the holder. It should be noted that thru-bore 6 is of sufficient size that when combined with the inclined top surface 18, the dryer may be angled downwardly. In this position, the dryer will rest along top surface 18 and direct the air in a more downward direction. Rotation of the dryer will cause an angle change as the barrel of the dryer is moved along top surface 18. In this manner, one may locate the dryer in order to direct the air stream at a preferred height after which the dryer will remain in place and the user will have both hands free. In this manner, no additional clamps, brackets or similar fastening structures are required to fix the dryer in a set position on the holder.

Figure 1:
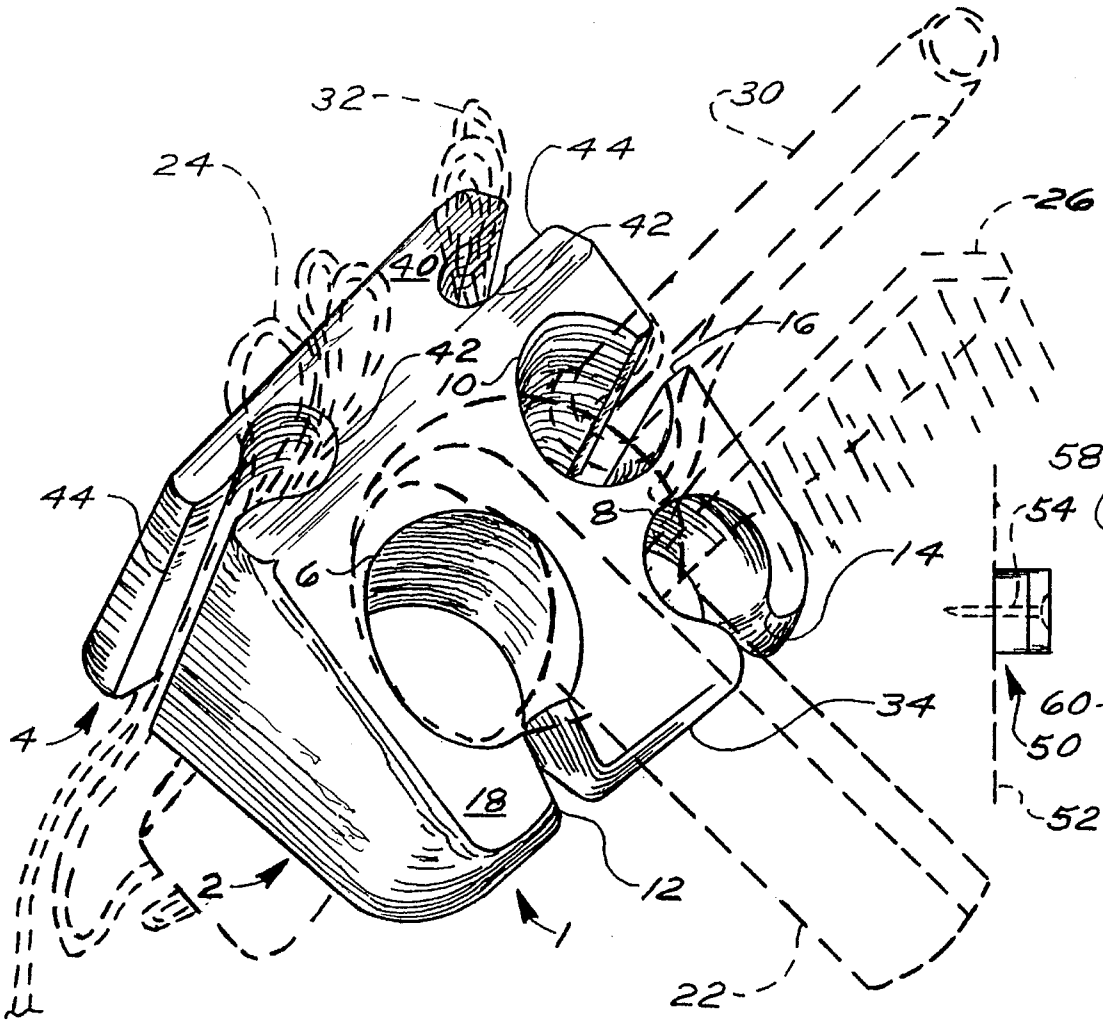
FIG. 1 provides a perspective view of a holder in accordance with the invention and also shows in phantom a number of hair treating implements.

The rear section 4 of the holder has a flat, horizontally-oriented top surface 40 and two apertures/cord receivers 42. A slot 44 is located in the side of each aperture and extends from the top surface to the bottom surface of the holder's rear section. As can be seen in FIG. 1, each of the apertures is designed to receive the electrical cord of one of the implements being supported by the front section of the holder. Each cord is preferably folded prior to its entry into one of the apertures 42 and thereby can be rapidly and easily removed from the aperture via the aperture's side slot 44.

Alternatively, a user can wind a cord around the holder wherein the cord would pass through both apertures 42 via their associated side slots 44. The cord would thereby encircle the holder. However, when wound in this fashion, the cord cannot be quickly removed from the holder in the same rapid manner in which the folded cord can be removed. Also, winding the cord around the holder is slightly more difficult and time consuming than merely folding the cord as shown.

Figure 3:
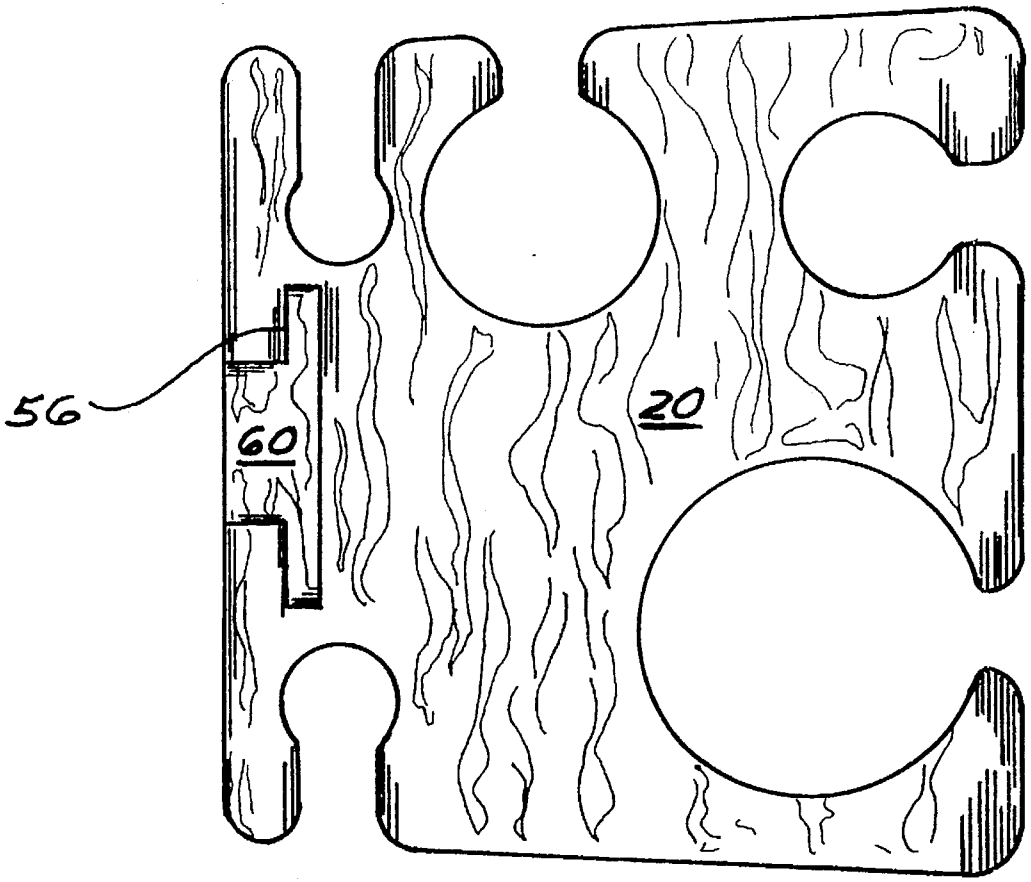
FIG. 3 is a bottom view of the holder and bracket shown in FIG. 2.
Figure 4:
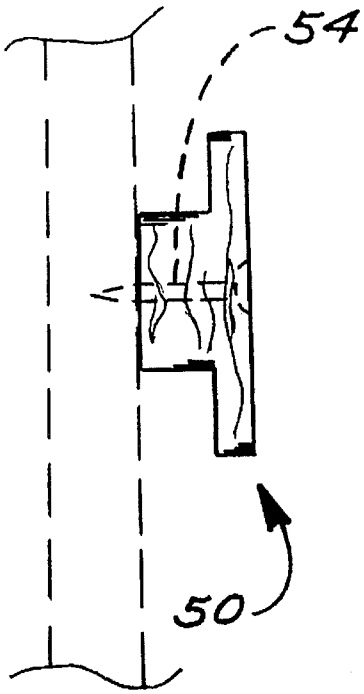
FIG. 4 is a plan view of a bracket used to secure the holder of FIG. 1 to a support. A support surface and fastener are shown in phantom.

In FIGS. 2 and 3, the preferred method of mounting the holder to a vertical structure is shown.

A two-part mounting system is used. The first part of the system is a "T"-shaped rigid bracket 50 that is secured to a vertical foundation such as the wall 52 shown in phantom in the figures. The bracket is secured using one or more screw-type fasteners 54.

The second part of the mounting system is a "T"-shaped groove 56 located on the back surface 58 of the holder. The groove extends from the holder's bottom surface to a point near the top surface of the holder's rear section. The groove therefore has a ceiling 60. The shape of the groove is complementary to the shape of bracket 50.

When the holder is to be installed on a vertical surface such as a wall, the bracket is first secured to the surface using one or more fasteners 54. The holder is then engaged to the bracket by fitting the bracket into groove 56 and then sliding the holder downwardly onto the bracket. Once the bracket comes into contact with the ceiling of the groove, the holder is then firmly and securely engaged to the wall. If necessary, the holder can be disengaged from the bracket and removed from the wall by merely applying upward pressure on the bottom of the holder. It should be noted that when only a single fastener 54 is used, the bracket can be rotated, thereby allowing the holder to be similarly rotated. In this manner, a user can rotate the holder and thereby reposition a supported hair dryer to achieve the most advantageous direction of the hair dryer's air flow. Alternatively, two spaced fasteners 54 (not shown) may be used to secure the bracket to the vertical surface in a non-rotatable manner.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. A hair dryer holder assembly comprising:

a holder having a front section and a rear section;

said front section having a front surface, a first side surface, a second side surface, a top surface and a bottom surface;

said rear section having a rear surface, a top surface and a bottom surface;

at least one bore located in the front section and extending between the top and bottom surface of said section, said at least one bore being open at top and bottom ends thereof, and wherein said at least one bore has a diameter capable of receiving a handle portion of a hair dryer;

at least one bore located in the rear section and extending between the top and bottom surface of said section, said at least one bore being open at top and bottom ends thereof, and wherein said at least one bore in said rear section is capable of receiving and storing a length of electrical cord; and attachment means for attaching said holder to a support means.

2. The holder of claim 1 wherein the attachment means is in the form of a bracket which is adapted for securement to a support means and which releasably fits into a shaped receiving means in the holder's rear section.

3. A hair dryer holder assembly comprising:

a holder having a front section and a rear section;

said front section having a front surface, a first side surface, a second side surface, a top surface and a bottom surface;

said rear section having a rear surface, a top surface and a bottom surface;

at least one bore located in the front section and extending between the top and bottom surface of said section, said at least one bore being open at top and bottom ends thereof and also having a side opening, and wherein said at least one bore has a diameter capable of receiving a handle portion of a hair dryer;

at least one bore located in the rear section and extending between the top and bottom surface of said section, said at least one bore being open at top and bottom ends thereof and also having a side opening, and wherein said at least one bore in said rear section is capable of receiving and storing a length of electrical cord; and attachment means for attaching said holder to a support means.

4. The holder of claim 3 wherein the attachment means is at least partially located on the rear surface of the holder's rear section.

5. The holder of claim 4 wherein the attachment means is in the form of a bracket which is adapted for securement to a support means and which releasably fits into a shaped receiving means in the holder's rear section.

6. The holder of claim 3 wherein said at least one bore has a vertically-aligned longitudinal axis and has a diameter of approximately two inches.

7. The holder of claim 3 wherein the top surface of the front section of the holder is inclined relative to a horizontal axis.

8. The holder of claim 3 wherein a plurality of bores are located in the holder's front section and wherein each of said bores has open top and bottom ends and also has a side-located opening.

9. The holder of claim 8 wherein a plurality of bores are located in the holder's rear section and wherein each of said bores has open top and bottom ends and also has a side-located opening.

10. A hair dryer holder assembly consisting of:

a holder having a front section and a rear section;

said front section having a front surface, a first side surface, a second side surface, a top surface and a bottom surface;

said rear section having a rear surface, a top surface and a bottom surface;

a plurality of bores located in the holder's front section said bores extending between the top and bottom surface of said section, each of said bores having open top and bottom ends and also having a side opening, and wherein at least one of said bores has a diameter capable of receiving a handle portion of a hair dryer;

a plurality of bores located in the holder's rear section, said bores extending between the top and bottom surface of said section and having open top and bottom ends and also each having a side opening, and wherein said bores in said rear section are each capable of receiving and storing a length of electrical cord; and attachment means for attaching said holder to a support means.

11. The holder of claim 10 wherein the top surface of the holder's front section is inclined relative to a horizontal plane.

* * * * *